US007938717B2

(12) United States Patent
Stuhlmacher

(10) Patent No.: US 7,938,717 B2
(45) Date of Patent: May 10, 2011

(54) CONFORMABLE SANDING PAD

(75) Inventor: Glen Stuhlmacher, San Ramon, CA (US)

(73) Assignee: Glen Stuhlmacher, II, San Ramon, CA (US)

( * ) Notice: Subject to any disclaimer, the term of this patent is extended or adjusted under 35 U.S.C. 154(b) by 0 days.

(21) Appl. No.: 11/881,578

(22) Filed: Jul. 27, 2007

(65) Prior Publication Data

US 2008/0032614 A1 Feb. 7, 2008

Related U.S. Application Data

(60) Provisional application No. 60/834,666, filed on Aug. 1, 2006.

(51) Int. Cl.
*B24B 15/04* (2006.01)

(52) U.S. Cl. ..... 451/495; 51/297; 51/298; 428/411.1; 451/523; 451/533

(58) Field of Classification Search ..... 51/297, 51/298; 451/495, 523, 533; 428/411.1
See application file for complete search history.

(56) References Cited

U.S. PATENT DOCUMENTS

| | | | | | |
|---|---|---|---|---|---|
| 5,109,637 | A * | 5/1992 | Calafut | ..... | 451/495 |
| 5,275,181 | A * | 1/1994 | Rudolph, Jr. | ..... | 132/76.4 |
| 5,287,863 | A * | 2/1994 | La Joie et al. | ..... | 132/76.4 |
| 5,640,737 | A * | 6/1997 | Boggs | ..... | 15/118 |
| 5,666,981 | A * | 9/1997 | Stephens | ..... | 132/76.4 |
| 5,885,148 | A * | 3/1999 | Vargas et al. | ..... | 451/523 |
| 6,488,574 | B1 * | 12/2002 | Calafut | ..... | 451/523 |
| D506,587 | S * | 6/2005 | Armaly, Jr. | ..... | D32/40 |

* cited by examiner

*Primary Examiner* — Timothy V Eley

(57) ABSTRACT

A flexible, hand-held sanding pad comprises a conformable, multi layered, semicircle pad having a surface capable of providing temporary adhesive attachment for a sheet of pressure-sensitive adhesive-coated abrasive material.

9 Claims, 1 Drawing Sheet

CONFORMABLE SANDING PAD

Cross-reference to related application 60/834,666. applicant claims the benefit of earlier provisional patent application 60/834,666 filed on Aug. 1, 2006.

BACKGROUND OF THE INVENTION

1. Field of the Invention

This invention relates to an improved sanding pad for holding and supporting a sheet of pressure-sensitive adhesive-coated abrasive material during hand sanding operations.

2. Prior Art

Coated abrasive sheet materials are used in any of a wide variety of applications. Many applications require hand sanding where the user will grasp a coated abrasive sheet in his hand and apply it to the surface being treated. Such use has fostered numerous devices to assist in the holding of the coated abrasive sheet to avoid injuring the hand or fingers while maintaining the requisite position of and pressure on the coated abrasive sheet to its optimum effect. Improper positioning will cause uneven abrasion of the treated surface. Irregular pressure, such as caused by the fingers against the back side of the abrasive sheet in use, produces an irregular abraded surface.

Early holding devices used for this purpose were inflexible blocks of solid material such as wood over which the coated abrasive sheet was wrapped. While these devices were adequate for some purposes, they required some means of holding or attachment of the ends of the coated abrasive sheet while applying one face of the block against the surface being treated, thus not making the maximum efficient use of the paper since the ends are generally never exposed to the surface being treated. Various sanding blocks of this type employing means for grasping the ends of the abrasive sheet are known, for example as disclosed in U.S. Pat. Nos. 2,765,593 and 1,562,414. U.S. Pat. No. 1,562,414 discloses a similar hand block which requires at least a part of the block to be formed of a material which is somewhat flexible but sufficiently rigid to retain the ends of the abrasive sheet in slots cut therein.

There has been developed and marketed a self-adhering coated abrasive sheet and rotatable disc material using pressure-sensitive adhesive coated on its back side so that it may be adhered directly to the working face of a sanding block or rotatable disc sanding head. For the most part, this means of attachment assures exposure of the entire abrasive face of the abrasive sheet. Such abrasive sheets are disclosed in U.S. Pat. Nos. 2,485,295, 3,849,949 and 3,912,142. This type of abrasive sheet has been extremely useful in conjunction with hard sanding blocks such as the types mentioned above and for rotatable disc sanding heads.

while the rigid sanding blocks are useful for sanding flat areas or areas with moderate surface variation, such as curved parts with a large radius of curvature, great quantities of abrasive sheet material are still used on complex surfaces, such as carved patterns, curved parts having a smaller radius of curvature and the like, without a pad. There has been no acceptable sanding pad, prior to the present invention, which is sufficiently conformable to be used to sand complex surfaces and particularly which can use pressure-sensitive adhesive coated abrasive disc material.

SUMMARY OF THE INVENTION

The present invention provides a novel improved sanding pad for holding and supporting a sheet of pressure-sensitive adhesive-coated abrasive material during hand sanding operations which overcomes the problems noted above. The sanding pad of this invention is ideally suited for use with pressure-sensitive adhesive-coated abrasive disc material.

The sanding pad of the present invention comprises a conformable, three layer, self-supporting pad which has an outer surface capable of providing adhesive attachment for a sheet of removable pressure-sensitive adhesive-coated abrasive material. The inner stabilization and support layer has sufficient body and integrity to distribute the forces provided by the fingertips and palm surface to eliminate discontinuities caused by finger impressions.

The conformable, self-supporting pad is sufficiently conformable to permit the coated abrasive disc to conform to irregular shapes such as may be found on automobiles, and depressed and raised patterns on furniture or woodwork. The outer surface of the conformable pad upon which the pressure-sensitive adhesive-coated abrasive disc is adhered provides for temporary adhesive attachment, permitting clean removal, yet securing the sheet firmly even during the most strenuous sanding operations.

These and other objects, advantages and embodiments will become more apparent when read with the accompanying figures and detained description.

DETAILED DESCRIPTION OF THE INVENTION

Figure 1:
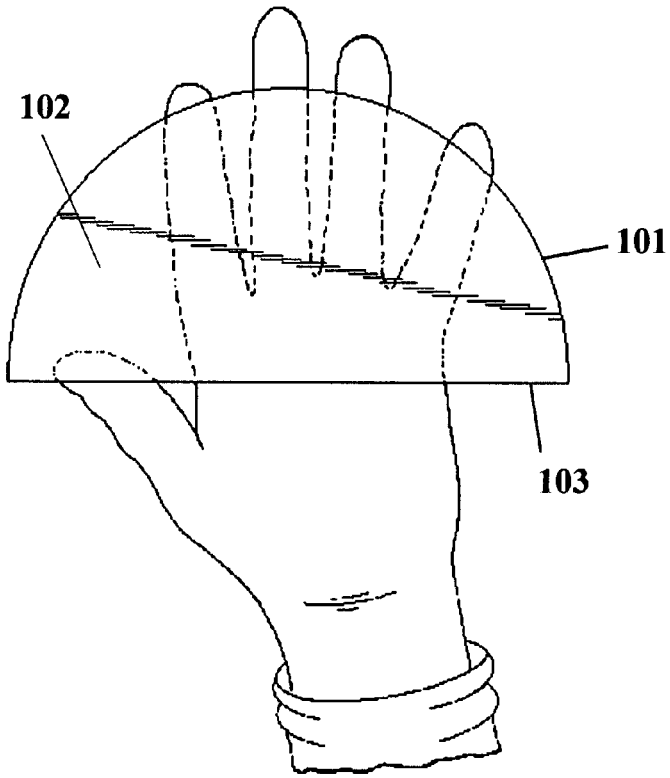
FIG. 1 is a plan view of the preferred sanding pad of the invention in position on the hand.
Figure 3:
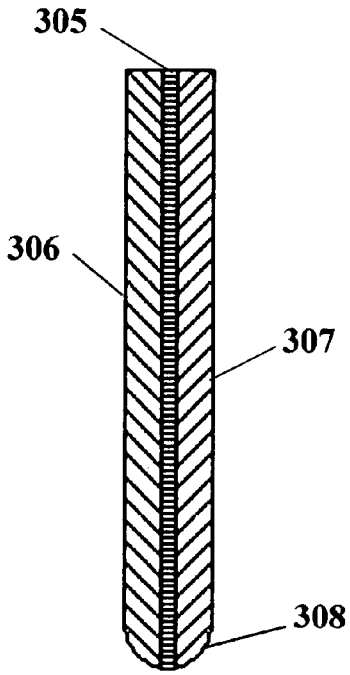
FIG. 3 is a cross-sectional end view of the sanding pad shown in FIG. 1.
Figure 2:
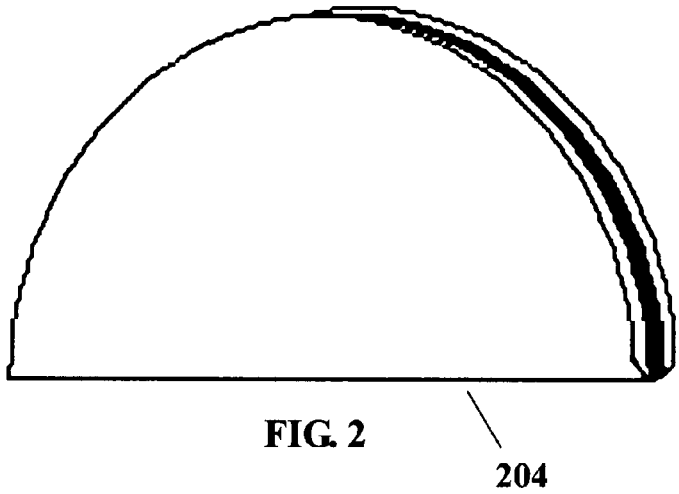
FIG. 2 is a perspective view of the sanding pad shown in FIG. 1.
Figure 4:
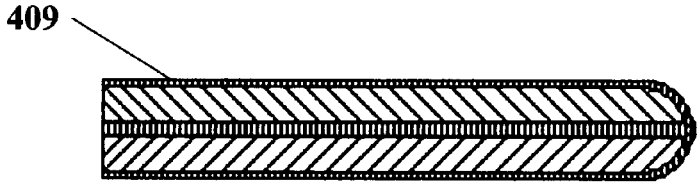
FIG. 4 is a cross-sectional end view of the sanding pad shown in FIG. 1 with a sheet of pressure-sensitive adhesive-coated abrasive material adhered on its outer surface.

Referring to the accompanying drawing, in which like reference numerals refer to like parts, a sanding pad 101 is shown which has a top surface 306 and bottom surface 307 capable of providing temporary adhesive attachment for a sheet 409 of pressure-sensitive adhesive-coated abrasive material.

The pad must be a size convenient for holding in the hand. It has been found that sizes ranging from about 5 to about 8 inches are quite adequate. The shape of the pad is preferably a semicircle, as shown in the drawing.

The conformable pad is at least about 3/16 inch thick, preferably at least 3/8 to 3/4 inch thick. The pad is formed of a material which is conformable and for the most part will conform easily around intricate and complex shapes, yet it has sufficient body and integrity to distribute the forces provided by the fingertips and palm. For convenient application of a pressure-sensitive coated abrasive sheet, the conformable pad should not be so conformable as to hang limp from the handle means. It may be difficult to apply the adhesive face of the abrasive sheet to a pad which is too limp.

Any of a wide variety of conformable sheet materials have been found to be suitable for forming the conformable pad of the sanding pad of the present invention. Useful materials include solid rubber sheets or sheets of open or closed cell foam rubber formed of natural rubber, silicone rubber, neoprene, nitrile rubber, SBR rubber, vinyl rubber, epichlorohydrin rubber, ethylene propylene diene terpolymer rubber, polyurethane rubber, and the like; sheets of reticulated material formed of thermoplastic materials such as polyvinyl chloride, polypropylene, polystyrene, and the like; nonwoven fabrics which may be formed of adhesively bonded staple fibers or of mechanically integrated fibers, e.g., felt; woven or knit fabrics; embossed-surfaced plastic material such as embossed films of polyvinyl chloride, polyurethane, polyethylene, polypropylene; natural sheet goods such as leather, and laminations of one or more of the above. The preferred pad is formed of laminated closed cell neoprene.

The materials which are sufficiently soft and conformable will have a Shore A durometer hardness value of less than about 60. Harder materials will not be easily conformable to complex surfaces.

The surface of the pad is a closed cell neoprene to prevent permanent adhesion of the pressure-sensitive adhesive coated-abrasive sheet material and to provide temporary attachment of the pressure-sensitive coated-abrasive sheet.

The intermediate stabilization and support layer 305 will preferably have a Shore A durometer hardness value between 30 and 60. This will allow the pad the ability to maintain a sufficient body and integrity to distribute the forces provided by the fingertips and palm surface to eliminate discontinuities caused by finger impressions.

The top surface 306 and bottom surface 307 will preferably have a Shore A durometer hardness value between 20 and 40. This will provide the necessary flexural rigidity to conform to complex surfaces and prevent permanent adhesion of the pressure-sensitive adhesive coated-abrasive sheet material.

The semicircle straight edge 204 has rounded corners 308, arched from top surface layer 306 to bottom surface layer 307 to allow a single round disc of pressure-sensitive adhesive coated-abrasive sheet material 409 to be applied to the top surface 306 and bottom surface 307 preventing any creasing or crinkling.

What is claimed is:

1. A hand-held sanding pad for abrasive material wherein said pad is a semicircle having a straight edge comprising:

(1) a composite sheet structure of synthetic rubber having a top surface layer, a bottom surface layer, and an intermediate layer, (2) said straight edge is arched from said top surface layer to said bottom surface layer.

2. The sanding pad of claim 1 wherein said top surface layer has a flexural rigidity equal to that of said bottom surface layer.

3. The sanding pad of claim 1 wherein said intermediate layer has a flexural rigidity higher than that of said bottom surface layer and said top surface layer.

4. The sanding pad of claim 1 wherein said bottom surface layer and said top surface layer being formed of a Shore durometer hardness value lower than that of said intermediate layer.

5. A semicircle hand-held sanding pad comprising:

(1) a composite sheet structure of highly conformable resilient closed cell synthetic rubber having a top surface layer, a bottom surface layer, and an intermediate stabilization and support layer, (2) the top surface layer and bottom surface layer is capable of providing adhesive attachment for a sheet of removable pressure-sensitive adhesive-coated abrasive material with an intermediate stabilization and support layer joining and supporting the top and bottom surface layer, (3) said pad has at least one straight edge, (4) said straight edge has rounded corners.

6. The sanding pad of claim 5 wherein said semicircle straight edge is arched from said top surface layer to said bottom surface layer.

7. The sanding pad of claim 6 wherein said top surface layer has a flexural rigidity equal to that of said bottom surface layer.

8. The sanding pad of claim 5 wherein said intermediate layer has a flexural rigidity higher than that of said bottom surface layer and said top surface layer.

9. The sanding pad of claim 5 wherein said bottom surface layer and said top surface layer being formed of a Shore durometer hardness value lower than said intermediate layer.

* * * * *